US008272513B1

(12) United States Patent
Leventhal

(10) Patent No.: US 8,272,513 B1
(45) Date of Patent: Sep. 25, 2012

(54) CARD AND STAMP SET AND PACKAGE

(75) Inventor: Jacqueline Leventhal, Richmond, CA (US)

(73) Assignee: Hero Arts Rubber Stamps, Inc., Richmond, CA (US)

( * ) Notice: Subject to any disclaimer, the term of this patent is extended or adjusted under 35 U.S.C. 154(b) by 0 days.

(21) Appl. No.: 13/482,152

(22) Filed: May 29, 2012

(51) Int. Cl.
*B65D 69/00* (2006.01)

(52) U.S. Cl. ..... 206/575; 206/459.5

(58) Field of Classification Search ..... 206/223, 206/575, 576, 224, 229, 232, 38, 457, 459.5; 229/116.1
See application file for complete search history.

(56) References Cited

U.S. PATENT DOCUMENTS

| | | | | |
|---|---|---|---|---|
| 3,311,227 | A * | 3/1967 | David et al. | 101/333 |
| 5,357,861 | A * | 10/1994 | d'Arbelles et al. | 101/327 |
| 7,971,721 | B1 * | 7/2011 | McMillan | 206/575 |
| 2005/0098471 | A1 * | 5/2005 | Klundt | 206/575 |
| 2007/0037129 | A1 * | 2/2007 | Boyer | 434/81 |
| 2008/0230402 | A1 * | 9/2008 | Macor | 206/81 |
| 2009/0146409 | A1 * | 6/2009 | Lesur | 283/73 |
| 2010/0170813 | A1 * | 7/2010 | Faber | 206/216 |

* cited by examiner

*Primary Examiner* — Jacob K Ackun
(74) *Attorney, Agent, or Firm* — H. Michael Brucker

(57) ABSTRACT

Non-specific greeting cards having a graphic design blank area and a plurality of occasion-specific rubber stamps with their impression graphic displayed on the top of the stamp handle in a package that permits the graphic design of the cards and the stamp impression graphics to be viewed directly without opening the package.

4 Claims, 3 Drawing Sheets

CARD AND STAMP SET AND PACKAGE

BACKGROUND OF THE INVENTION

The present invention relates to greeting cards and, more particularly, to greeting cards and rubber stamps in a package.

Greeting cards can be divided into two broad categories: those that have printed matter that is specific to a particular occasion or event (e.g., a birthday or a wedding or a get well wish, etc) and those that have printed matter but not including anything specific to any occasion (sometimes referred to as "blank" cards).

BRIEF DESCRIPTION OF THE INVENTION

The present invention provides a package that contains a plurality of cards that have decorative printed matter (words and/or graphics) that is not specific to any occasion and a plurality of rubber stamps each of which has a handle and an impression transfer member that, together with ink, is capable of imprinting a word or message on a card that is specific to a particular occasion or event. The particular word or message of each rubber stamp is displayed on its handle just as it appears when imprinted by the impression transfer member.

The cards and stamps are arranged in a package that permits the decorative printed matter of the cards (as opposed to a copy thereof) and the handles of the rubber stamps to be seen without opening the package.

The foregoing and other features and advantages of the invention will be more readily understood upon consideration of the following detailed description of the invention taken in conjunction with the accompanying drawings.

DETAILED DESCRIPTION OF THE PREFERRED EMBODIMENTS

Figure 1:
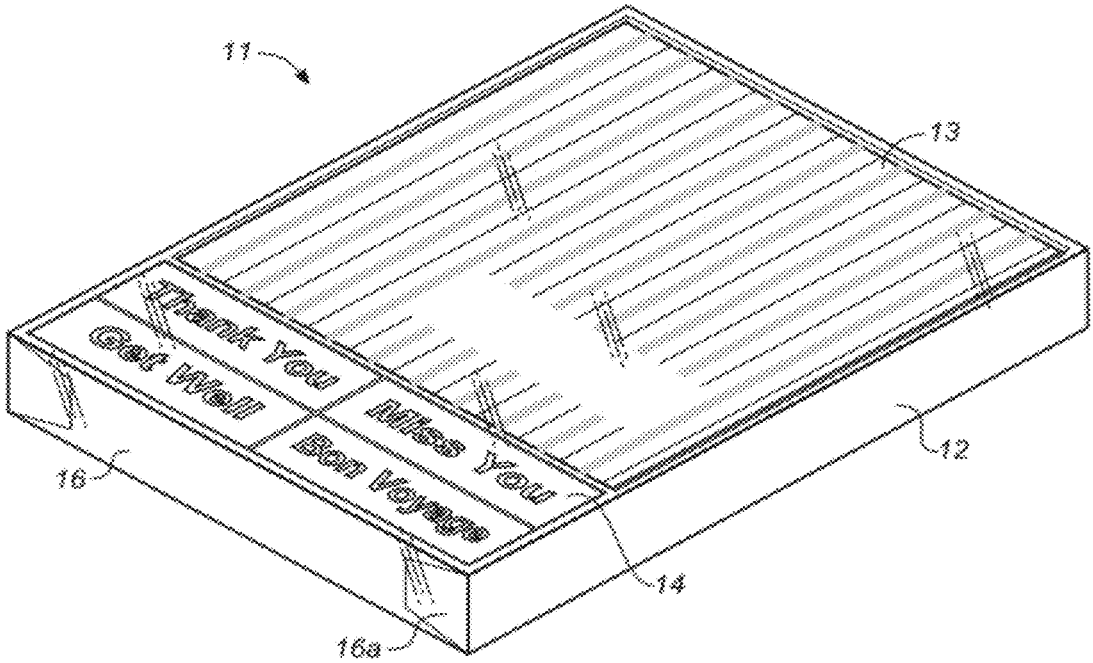
FIG. 1 is a perspective view of the assembled package of the invention.

Referring to the drawings, the card and stamp set and package 11 of the present invention comprises: an open top box 12; a plurality of cards 13; a plurality of rubber stamps 14; and a transparent box sleeve 16 for receiving and closing the box 12 and containing its contents.

The box 12 has a generally flat, rectangular, bottom member 18, upstanding side walls 19 and end walls 20 that are attached to and surround the bottom member 18 which, together, create a box having a volume 21. The box 12 can be formed from paper or plastic as is well known in the art. The box volume 21 is divided into a card compartment 21*a* and a stamp compartment 21*b* by an upstanding divider member 22 that spans and is attached to opposing side walls 19. The height of the side walls 19, end walls 20 and the divider member 22 are approximately equal. The card compartment 21*a* is sized to be slightly larger than the size of cards 13 whereby a plurality of cards 13 can be stacked into compartment 21*a* where they will be restrained. In one embodiment, envelopes (not shown) are included with the cards.

While the invention is illustrated as having two compartments 21*a* and 21*b*, in an alternative embodiment, one or more additional compartments are provided to contain decorative materials such as glitter or gems or the like.

Figure 3:
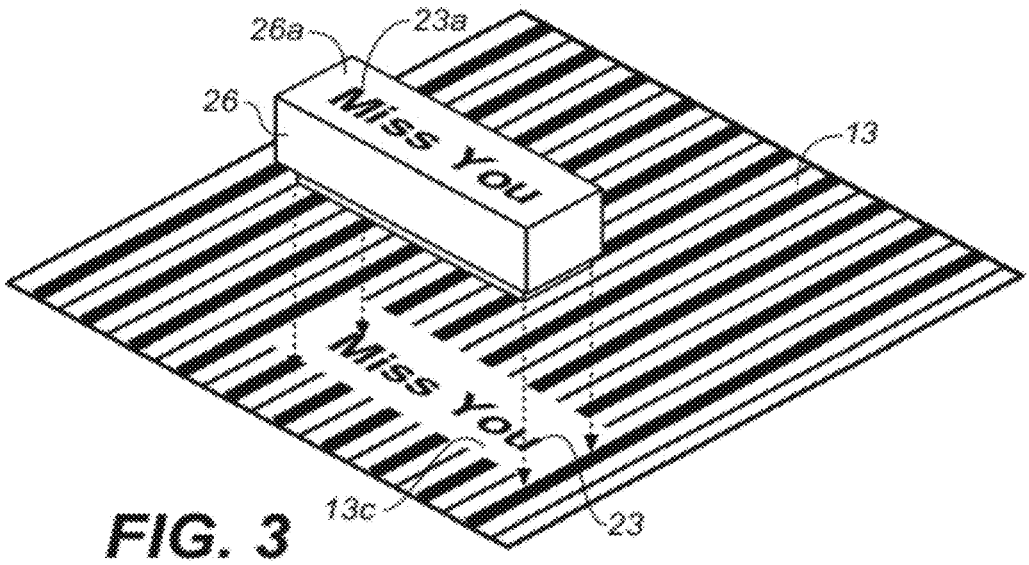
FIG. 3 is a perspective view showing the application of a stamp impression onto a card.

The cards 13 are imprinted on one surface 13*a* with a decorative graphic design 13*b* including a designated blank area 13*c* suitable for receiving a rubber stamp impression 23 (FIG. 3). When packaged, the cards 13 are stacked in the compartment 21*a* such that the uppermost card 13 has its imprinted surface 13*a* facing the open top of the box 12 (FIG. 1).

Figure 4:
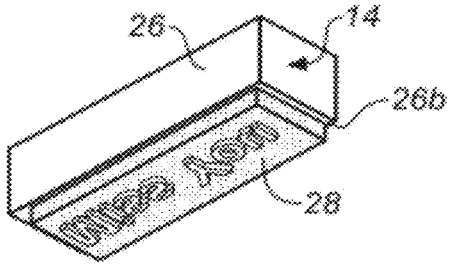
FIG. 4 is a lower perspective view of a stamp.

The rubber stamps 14 each comprise a handle portion 26 (FIGS. 3 and 4) having a plurality of surfaces including a generally flat top handle surface 26*a* and an impression transfer member 28 secured to a handle surface 26*b* that is opposite handle surface 26*a* (FIG. 3). The impression transfer member 28, when inked, is capable under pressure of imprinting a graphic image impression 23 (FIG. 3) onto a surface as is well known in the art. The graphic image impression 23 is sized to fit within the boundaries of blank area 13*c* on the card 13 and can include words and/or symbols.

While the stamps 14 have been referred to as "rubber stamps", those skilled in the art will understand that the impression transfer member 28 can be made not only of rubber but of any of the other materials known in the art to be used as an ink transfer medium. Thus, the term "rubber stamp" as used herein is intended to mean and include stamps having transfer members of materials other than rubber.

Figure 2:
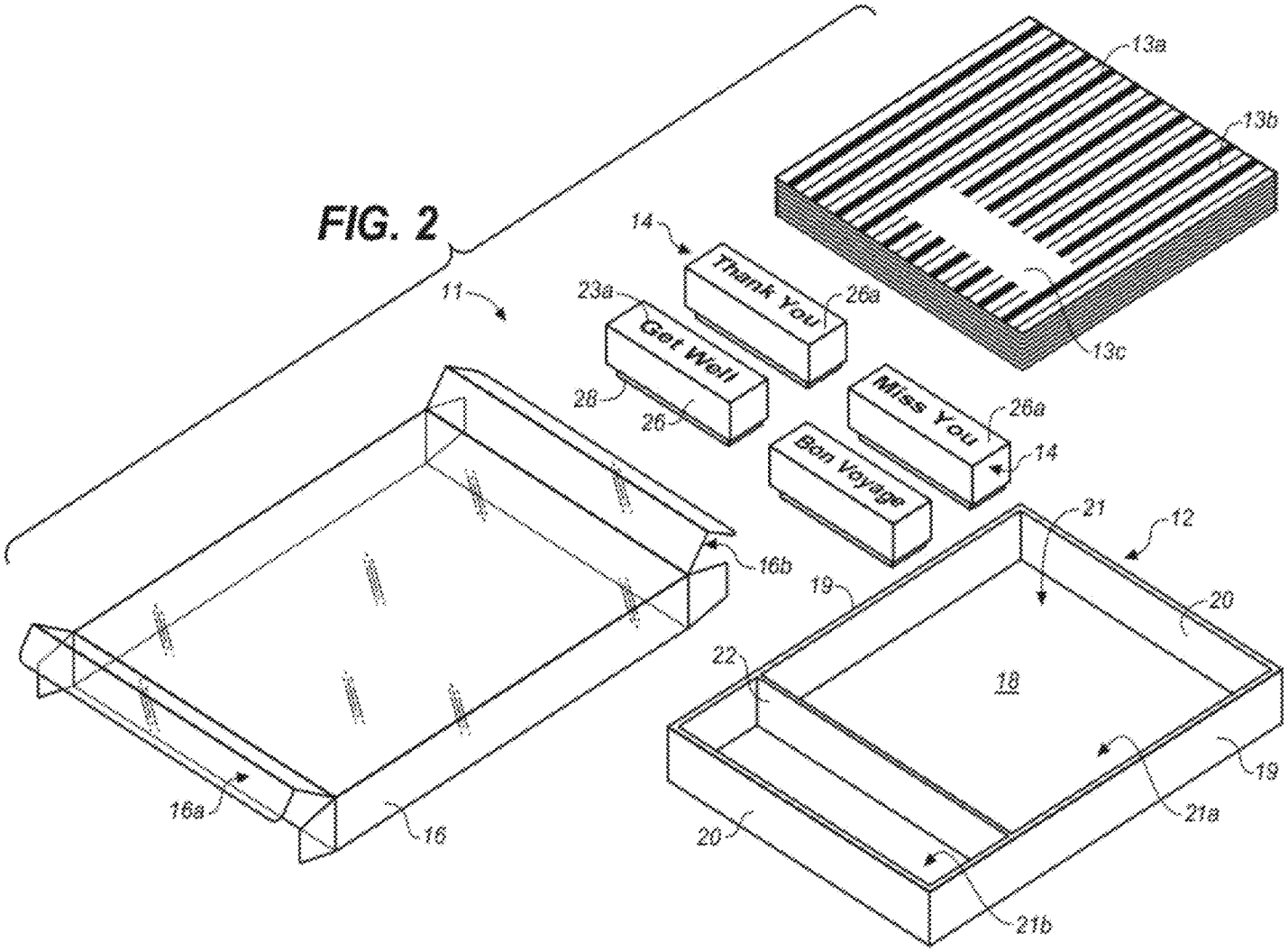
FIG. 2 is an exploded perspective view of the disassembled package.

The same graphic image impression 23*a* as image 23 is imprinted on the top handle surface 26*a* so that the exact graphic of each stamp 14 is easily seen (FIG. 2). The plurality of rubber stamps 14 fit into the box compartment 21*b* where they are restrained to retain their orientation. Moreover, the rubber stamps 14 are disposed and oriented in the box compartment 21*b* such that the generally flat surfaces 26*a* of each handle 26 is facing the open top of the box 12 whereby the graphic 23*a* of that stamp is visible.

The transparent sleeve 16 typically made of a clear plastic is sized to snuggly receive and surround the box 12 and its contents (cards 13 and stamps 14) and includes end closures 16*a* and 16*b* (FIG. 2). The cards 13*b* and their graphic design, as well as the ink stamp handles 26 and the graphic images 23*a* on the handles, can be seen through the sleeve 16 without opening the package. A clear closure for the open top of the box 12 can be provided by a traditional box cover (not shown) of a clear material in place of sleeve 16 without sacrificing any of the features of the invention.

The invention permits one set of non-specific cards 13 to be customized to a specific occasion by the use of a selected rubber stamp 14. The package permits the contents to be seen such that one can identify for use the appropriate stamps for a particular occasion without having to open the box closures 16, even where a plurality of sets 11 are available to choose from.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A card and stamp set and package therefore comprising;

a box having at least two compartments and having an open top; a plurality of cards imprinted on one surface with a decorative graphic design including a designated blank area for receiving an ink stamp impression disposed in one said box compartment oriented such that said graphic design surface is facing the open top of said box;

a plurality of rubber stamps each comprising a handle portion having a plurality of surfaces including a generally flat surface and an impression transfer member secured to a different one of said handle surfaces;

wherein said impression transfer member imprints a graphic image onto a surface when inked and applied with pressure to a surface;

wherein the size of said graphic image produced by said impression transfer member fits within said designated blank area of said card;

wherein said handle generally flat surface has imprinted thereon the same graphic image that its said impression transfer member imprints;

wherein said plurality of said rubber stamps are disposed in another of said box compartments oriented such that the generally flat surfaces of said handles having imprinted thereon the same graphic image that its said impression transfer member imprints are facing the open top of said box; and a transparent cover closing the open top of said box whereby said actual cards and their graphic design, said ink stamp handles and said ink stamp graphic images on said handles can be seen without opening the package.

2. The card and stamp set and package therefore of claim 1 wherein the graphic image of said rubber stamps are event or occasion specific.

3. The card and stamp set and package therefore of claim 2 wherein the graphic image of each said rubber stamp is event or occasion specific and of a different event or occasion than the other said stamps.

4. The card and stamp set and package therefore of claim 1 wherein said box has at least three said compartments and card decorating material is contained in one of said compartments.

* * * * *